US010808400B2

(12) United States Patent
Binder

(10) Patent No.: US 10,808,400 B2
(45) Date of Patent: Oct. 20, 2020

(54) METHOD OF MANUFACTURING WALL ELEMENTS FOR BUILDINGS

(71) Applicant: Binder Beteiligungs AG, Fuegen (AT)

(72) Inventor: Mattheo Johannes Binder, Fuegen (AT)

(73) Assignee: Binder Beteiligungs AG, Fuegen (AT)

( * ) Notice: Subject to any disclaimer, the term of this patent is extended or adjusted under 35 U.S.C. 154(b) by 121 days.

(21) Appl. No.: 16/170,300

(22) Filed: Oct. 25, 2018

(65) Prior Publication Data

US 2019/0136519 A1 May 9, 2019

(30) Foreign Application Priority Data

Nov. 6, 2017 (DE) ..... 10 2017 125 829

(51) Int. Cl.
*B27M 1/08* (2006.01)
*E04B 2/70* (2006.01)
(Continued)

(52) U.S. Cl.
CPC ..... *E04B 2/70* (2013.01); *B27B 5/06* (2013.01); *B27M 1/08* (2013.01); *B27M 3/0026* (2013.01); *B65D 9/34* (2013.01); *E04B 1/00* (2013.01); *E04B 1/10* (2013.01); *E04B 1/34815* (2013.01); *E04B 1/34838* (2013.01);
(Continued)

(58) Field of Classification Search
CPC ..... B27M 1/00; B27M 1/08; B27M 3/0026; B27M 3/002; B27M 3/006; B27B 5/06
See application file for complete search history.

(56) References Cited

U.S. PATENT DOCUMENTS 2,037,895 A 4/1936 Gugler
2,340,323 A 2/1944 Groeniger
(Continued)

FOREIGN PATENT DOCUMENTS

DE 101 25 349 A1 12/2002
EP 2 617 911 B1 4/2016
(Continued)

OTHER PUBLICATIONS

German Examination Report dated Sep. 7, 2018 in German Application No. 10 2017 125 829.9 with English translation of the relevant parts.
(Continued)

*Primary Examiner* — Matthew Katcoff
(74) *Attorney, Agent, or Firm* — Collard & Roe, P.C.

(57) ABSTRACT

A method of manufacturing wall elements for buildings, cross laminated timber panels of a specific width and length stocks in a store, and the panels are sawed up transversely to the longitudinal direction to obtain cross laminated timber panels of the same width and smaller length. A plurality of panels are placed onto a conveying track transversely to the direction of running, and indeed such that the panels are flush at the top and bottom and the side edges of consecutive panels contact one another. The panels on the conveying track are connected along the contacting longitudinal sides to form a cross laminated timber apron. The apron is sawed up transversely to the direction of running of the conveying track to obtain cross laminated timber boards of a defined width.

10 Claims, 6 Drawing Sheets

(51) Int. Cl.

| | |
|---|---|
| ***E04B 1/10*** | (2006.01) |
| ***E04B 1/348*** | (2006.01) |
| ***E04C 2/12*** | (2006.01) |
| ***B65D 6/34*** | (2006.01) |
| ***B27B 5/06*** | (2006.01) |
| ***B27M 3/00*** | (2006.01) |
| ***E04B 2/00*** | (2006.01) |
| ***E04B 1/00*** | (2006.01) |
| ***E04C 2/24*** | (2006.01) |

(52) U.S. Cl.
CPC ..... *E04B 1/34869* (2013.01); *E04C 2/12* (2013.01); *E04C 2/24* (2013.01); *E04C 2/46* (2013.01); *E04B 2103/04* (2013.01)

(56) References Cited

U.S. PATENT DOCUMENTS

| | | | | |
|---|---|---|---|---|
| 4,111,247 | A * | 9/1978 | Hasenwinkle | B27B 1/005 144/351 |
| 5,934,347 | A * | 8/1999 | Phelps | B23D 59/008 144/3.1 |
| 6,701,984 | B2 * | 3/2004 | Lamontagne | B27M 1/08 144/3.1 |
| 6,960,277 | B2 * | 11/2005 | Brunet | B27M 1/08 144/347 |
| 8,245,741 | B2 * | 8/2012 | Filion | B27F 1/16 144/346 |
| 10,589,441 | B2 * | 3/2020 | Hirmke | B27M 3/0026 |
| 2003/0159366 | A1 | 8/2003 | Christensen | |
| 2009/0100769 | A1 | 4/2009 | Barrett et al. | |
| 2011/0041415 | A1 | 2/2011 | Esposito | |
| 2011/0099918 | A1 | 5/2011 | Buchmann | |
| 2013/0014451 | A1 | 1/2013 | Russell et al. | |
| 2017/0138639 | A1 | 5/2017 | Andrews et al. | |

FOREIGN PATENT DOCUMENTS

| | | |
|---|---|---|
| EP | 2 617 912 B1 | 4/2016 |
| EP | 2 617 913 B1 | 9/2016 |

OTHER PUBLICATIONS proHolz Austria Arbeitsgemeinschaft der oesterreichischen Holzwirtschaft: Die Aussenwand—zuschnitt vol. 43, booklet 43, 2011, pp. 1-28—ISBN 978-3-902320-85-8 (Translation: proWood Austria, copartnership of workers of the Austrian wood economy: the outer wall).

* cited by examiner

METHOD OF MANUFACTURING WALL ELEMENTS FOR BUILDINGS

CROSS REFERENCE TO RELATED APPLICATIONS

Applicant claims priority under 35 U.S.C. § 119 of German Application No. 10 2017 125 829.9 filed Nov. 6, 2017, the disclosure of which is incorporated by reference.

FIELD OF THE INVENTION

The present invention relates to a total concept for erecting buildings in modular construction, preferably multistory buildings that are designed for permanent residence. The concept includes a module for use in the erection of buildings in modular construction and a method of manufacturing wall elements for buildings.

In times of urbanization and of hugely increasing demand for living space in conurbations concepts are required with which a large number of residential units can be erected in a time-saving and inexpensive manner. An absolute demand on these concepts is a high degree of quality, customizability, and sustainability to achieve a clear delineation from the functional buildings of the 1960s and 1970s.

PRIOR ART

It is known in the prior art to produce larger buildings in modular construction using modules composed of cross laminated timber. It is furthermore known to integrate a wet area in these modules and to lead electrical lines and other lines through vertical ducts that are integrated in the modules. We refer, for example, to the construction of the BMW Hotel Alpenhof in Ammerwald, Austria, that is presented in the catalog zuschnitt 43, 2011 of the consortium proholz and to the elements presented in the European patents EP 2 617 911 B1, EP 2 617 912 B1, and EP 2 617 913 B1.

SUMMARY OF THE INVENTION

The concept of the present invention is based on the use of prefabricated wall parts and modules of wood, and preferably of cross laminated timber, with wet rooms and vertical ducts for all kinds of required lines (water, air, power, signal, etc.) being integrated in the modules. Provision is made that the wall parts and the modules are produced in an industrial scale from a plurality of identical wooden elements, with a high degree of customizability being presented by a special kind of production.

Modules for the fabrication of buildings are known in accordance with the prior art. They are above all used in the fabrication of temporary buildings and hotels and represent separate areas there.

Provision is, however, made as part of the present invention to integrate the modules as part of a larger unit in a floor of a multistory building, for example a residential building. Furthermore, a plurality of modules should be stacked on top of one another and the total installations of the building or at least a substantial part thereof should run through the stacked modules. This area of use and the associated constraints make high demands on the stability of the module, on the possibility for running lines, and on noise and fire protection. These demands can only be taken into account insufficiently with known concepts.

Against this background, it is an object of the invention to provide a module for use in the erection of buildings in modular construction that satisfies all the demands on stability, on sanitary installations, on the running of lines, and on noise and fire protection that the present concept makes on them.

Against this background, the invention relates to a module for use in the erection of buildings in modular construction, wherein the module has a parallelepiped-shaped basic design and has outer walls, a floor, and a ceiling, with the bearing components of some outer walls, and preferably of all the outer walls, preferably being cross-laminated timber, with the module including a useful area and at least two separate vertical ducts, with both vertical ducts running through the module from the bottom to the top and being respectively enclosed between at least one outer wall and at least one duct wall.

The industrial manufacture of larger wall elements such as are required, for example, in the manufacture of modules in accordance with the invention typically comprises the connection of a plurality of smaller panels along common side edges. If window openings or door openings are to be worked into the wall elements, they are typically cut out or machined out.

These known processes are not ideal for the present concept from a plurality of aspects. On the one hand, offcuts that can as a rule no longer still be used arise due to the machining out or cutting out of openings. The offcuts represent a significant cost factor in industrial fabrication and large volumes are not desirable from economic and ecological aspects. On the other hand, the observation of smaller dimensional tolerances in fabrication is difficult since deviations in the starting materials propagate into the finished wall elements. This cannot be tolerated within the framework of the concept in accordance with the invention since a very high dimensional accuracy is important for the quality and stability of the modules in accordance with the invention and of a building manufactured in accordance with the invention as a whole.

A partial aspect of the invention therefore deals with a method of manufacturing wall elements for modules, for example, that overcomes these disadvantages of known methods.

Against this background, the invention relates in a further aspect to a method of manufacturing wall elements for buildings, wherein wooden panels of a specific width and length are stored in a store, and wherein the panels are sawed up transversely to the longitudinal direction to obtain timber panels of the same width and of a smaller length, with a plurality of panels being placed transversely to the direction of running on a conveying track, and indeed such that the panels are flush at the top and bottom and the side edges of consecutive panels contact one another, with the panels on the conveying track being connected along the contacting longitudinal sides to form a timber apron, and with the apron being sawed up transversely to the direction of running of the conveying track to obtain boards of a defined width.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF THE INVENTION

The Module

Figure 1:
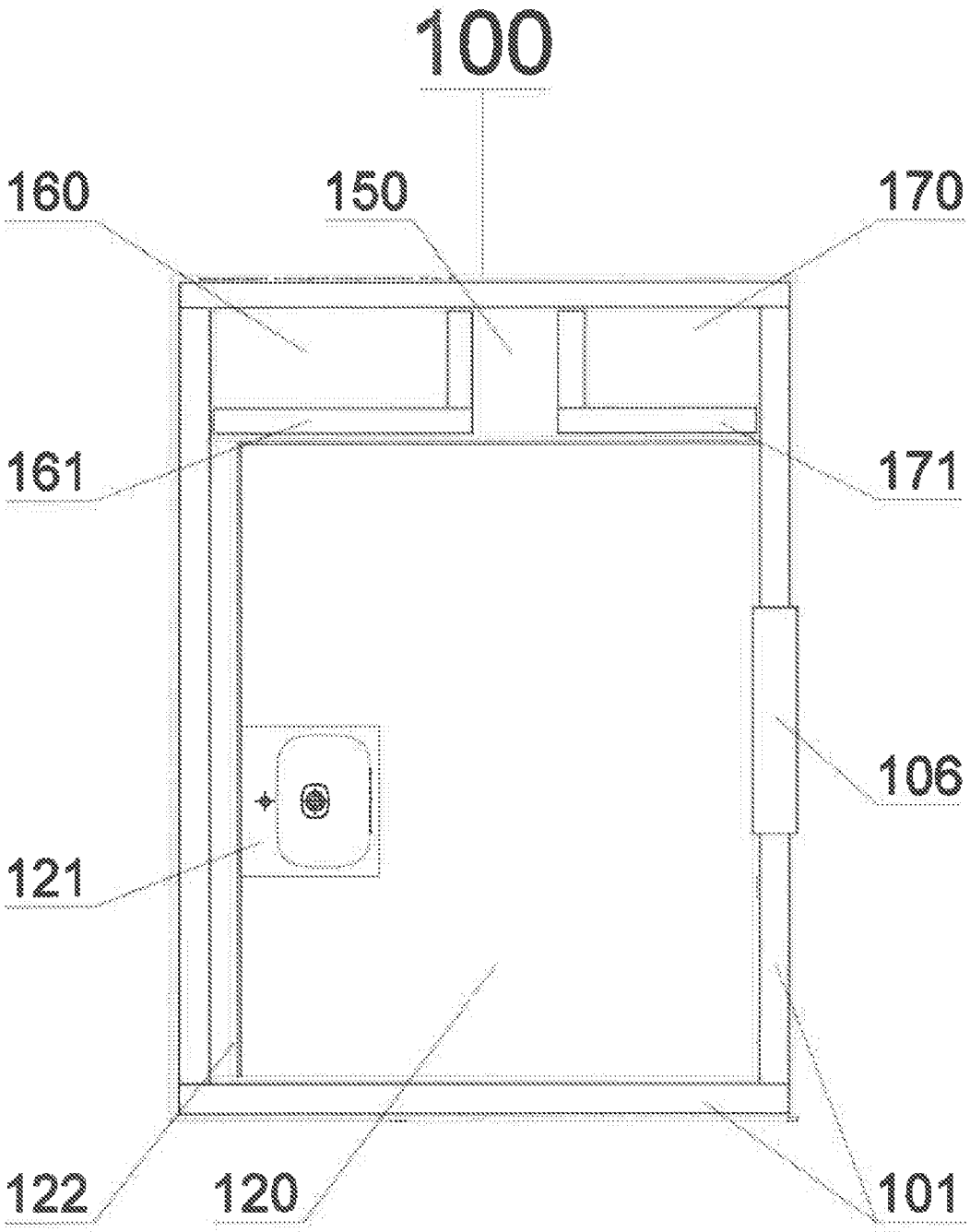
FIG. 1 shows an exemplary module in accordance with the invention in a ground plan.

An aspect of the invention relates to a module for use in the erection of buildings in modular construction, wherein the module has a parallelepiped-shaped basic design and has outer walls, a floor, and a ceiling, with the bearing components of some outer walls, and preferably of all the outer walls, being cross laminated timber, and with the module including a useful area and at least two separate vertical ducts, with both vertical ducts running through the module from the bottom to the top and being respectively enclosed between at least one outer wall and at least one duct wall.

The duct walls can comprise or consist of cross laminated timber. The buildings are preferably multistory buildings that are designed for permanent residence.

The ground plan of the module is preferably rectangular and the module preferably comprises four outer walls. At least two outer walls are preferably load-bearing and further preferably all the outer walls are load-bearing. Unlike a self-supporting wall that only bears its own weight and cannot bear a static load by other elements, a load-bearing wall can bear a static load by other building parts, for example a further module placed onto the module, and is configured to bear this load. Provision can, for example, be made that the box is configured to bear at least five times its own weight, and preferably at least eight times its own weight, so that a stacking of, for example, eight or also more than eight boxes is possible in a building of eight floors or of multiple floors.

The module is preferably closed all around, i.e. it preferably comprises four side walls. The bearing components of the floor and/or ceiling of the module can also be cross laminated timber boards. Cross laminated timber is very stiff and stable. It is well-suited as a load-bearing construction material. Wood as a construction material is environmentally compatible and renewable. It is comparatively inexpensive, durable, and is in demand as a construction material among customers. Provision can be made that the walls are produced completely from cross laminated timber that can be coated at least over a partial area on one side or on both sides or can be lined. The same applies to the ceiling and/or floor. The outer walls can have apertures for doors, for example.

The floor and the ceiling comprise apertures in the region of the vertical ducts so that the latter are open to the top and bottom or can be opened if the aperture is closed.

Provision is made in an embodiment that the duct is completely surrounded by the duct walls and by the outer walls laterally over the total height of the module so that openings for connection to corresponding ducts of the floor below and above are only provided at the upper and lower ends of the duct. A vertical acoustic decoupling can also be provided without any special insulation in every module between the vertical ducts and the useful area, with an insulation of the duct walls between the vertical ducts and the useful area of the module and with an insulation of the regions of the outer walls bounding the vertical ducts between the vertical ducts and the regions outside the module. Provision can additionally be made in an embodiment that the duct walls and/or regions of the outer walls bounding the vertical ducts are insulated.

A horizontal acoustic decoupling between two adjacent floors is no longer required due to this kind of vertical acoustic decoupling. Thus the noise can therefore admittedly propagate between the floors within the vertical ducts of modules stacked on top of one another; however, a noise propagation from the vertical duct is prevented by the vertical acoustic decoupling.

Provision is made in an embodiment that the duct walls and/or regions of the outer walls bounding the vertical ducts have fire-resistant cladding over the full area. The protective effect of the respective walls against fire spreading between the vertical ducts and the useful area of the module or the areas outside the module can be increased by such a cladding. One or more drywalls can, for example, be considered as fire-resistant cladding. Provision can be made that the fire protection is ensured with vertical penetrations by tested fire protection elements/measures.

Provision is made in an embodiment that the at least two vertical ducts are arranged along the inner side of one, and optionally the same, outer wall, with provision preferably being made that the vertical duct or ducts is/are arranged in a plant room that is separated from the useful area by a partition wall.

The duct walls, on the one hand, and the partition wall, on the other hand, are preferably separate elements. The partition wall can be a drywall. It can also be formed from a plurality of drywalls. The duct walls can, like the outer walls, be substantially formed from cross laminated timber boards.

Provision can be made that the vertical ducts only take up some of the plant room and that an installation area is formed in the plant room between the vertical ducts and/or between at least one vertical duct and the plant room cladding. The different duct lines and ductworks which will be looked at in more detail further below can be branched out of the vertical ducts into the installation area and can then be further distributed from there to any desired point in the useful area of the module or outside the module.

In an embodiment, an installation niche is provided in the partition wall for receiving compact stations and/or metering stations. Accessibility to this installation niche is preferably ensured by a service opening having a closure element, with the closure element preferably being configured such that it can be opened without tools.

In an embodiment, a compact station that prepares hot water in a decentralized manner from the building and that includes consumption meters for cold water, hot water, and heating energy is installed in the installation niche. This compact station is prepared for heat transfer by means of convective heating surfaces (radiators) in the usage units (residential units) in one embodiment and for heat transfer by means of panel heating in another embodiment.

In a further embodiment, a metering station for hot water preparation in a centralized manner in the building is installed in said installation niche, said metering station including consumption meters for cold water, hot water, and heating energy.

The main shut-offs for useful units (residential units) can be installed either in the compact station or in the metering station. A differential pressure regulation can furthermore be integrated for a hydraulic balance of the primary heating supply network. The configuration of the differential pressure regulation makes possible a standard dimensioning of the risers for all the heat transfer systems (convective heating panels, panel heating, etc.).

Provision is made in an embodiment that a plurality of risers for receiving different liquids and gases, for example water lines or ventilation lines, are installed in one of the vertical ducts.

Provision is made in an embodiment that a plurality of ductworks for receiving cables are provided in one vertical duct, preferably in the other one of the vertical ducts with respect to the vertical duct just named in connection with the risers.

The risers and ductworks are preferably distributed over the vertical ducts such that all the risers are received in one vertical duct and all the ductworks are received in another vertical duct, which can be necessary for safety reasons. The spatial separation of fluids and electrical installations is ensured by this embodiment.

Both the risers and the ductworks can be formed as pipe sections that extend from bottom to top in the vertical duct. Risers can directly serve the conducting of fluids such as drinking water, waste water, or extracted air. Ductworks can serve the reception of cables such as power cables or signal cables.

Provision is made in an embodiment that the ductworks are fixed in the vertical duct such that they can be displaced vertically downwardly from a defined starting position up to and into an end position and/or that the ductworks are socket pipes. In this embodiment, on the erection of a multistory building, a method is made possible in which the module is first placed onto a module disposed beneath it and in which then the ductworks of the current module are displaced downwardly and are thus plugged onto the ductworks of the lower module to form a continuous pipe.

Provision can therefore be made that on a stacking of a plurality of modules in accordance with the invention as part of the construction of a building, the ductwork in the duct is connected without tools by pushing downward and then a continuous connection of the current floor down to the lowest floor is formed. The apartment feeds (power, data, cable TV, . . . ) can, as described in more detail further below, be inserted without tools from top to bottom into this connection.

Provision is made in an embodiment that a plurality of identical ductworks of the same function are provided in the vertical duct. In this embodiment, it is made possible on the erection of a multistory building to sort the cable bundles simply by floor.

Provision is made in an embodiment that the module has cabling having one or a plurality of cables in that vertical duct in which the ductworks are arranged, with the cables each having a free end and a bound end, and with the bound ends of the cables being already connected to the module. The cables can, for example, already be connected to an electrical sub-distributor likewise arranged in the module. The electrical sub-distributor can be installed and completely wired in the module. If the cabling comprises a plurality of individual cables, they can be combined to one cable bundle. The length of the cables can be selected such that they at least extend beyond the lower side of the module. The length of the cables can exceed the height of two, three, or more modules in an embodiment. With a view to the use of the module in the erection of a building, the length of the cables of a module can be selected such that the cables extend, starting from the floor of the building in which the respective module is to be arranged, up to the lowest floor or foundation of the building in which, for example, the main meter distributor can be located. The long cables or the cable bundle can be present in meandering form or otherwise wound in the vertical duct.

In this embodiment, on the use of the module in the erection of a building, a method of connecting consumers or of an electrical sub-distributor of the module to a supplier is made possible in which the free ends of the cables are introduced into the upper opening of a ductwork of the module disposed beneath it that is optionally connected to the ductworks of a plurality of modules disposed underneath to form a long pipe and said free ends are led fully through this pipe until the free ends exit at the lower opening of this pipe with a predefined excess length. A tool-free cabling of the modules from the lowest floor or basement floor up to any desired floor is thus made possible.

To enable access to the ductworks of the modules or to the respective duct, a maintenance opening, for example an EI90 maintenance opening, can be provided. Provision is made in an embodiment that at least one linear magnetic bolt is provided, that is installed in hidden form, to lock this maintenance opening. Said bolt is preferably configured such that it can only be moved into the opening position by a special bridging cable. It is thus ensured that the duct remains inaccessible for unauthorized persons.

The vertical fire protection on a passage of cables through the duct wall is preferably ensured by tested fire-resistant elements/measures such as fire-resistant cuffs.

Provision is made in an embodiment that the risers, and preferably the ventilation line, each have at least one branch that leads out of the riser through the duct wall or through the outer wall, with a sound damper preferably being provided in or at the branch. The branch is required for the individual supply of the respective useful unit, for example, the residential unit. The sound absorber serves to prevent or at least reduce the transmission of sound such as telephony sound between the individual useful units. The vertical fire protection on passages of ventilation lines through the duct wall is preferably likewise ensured by tested fire-resistant elements/measures such as fire-resistant flaps.

Provision is made in an embodiment that the module comprises extracted air elements such as fans, suction openings, and suction ducts. The module can thus be connected to an extracted air plant regulated on demand. If the module has a plurality of rooms, extracted air elements can be provided for one, more, or for all the rooms.

On the erection of a multistory building using the modules, provision can be made to connect risers of adjacent floors to connection hoses or connection pipes that are preferably flexible. Provision can be made that the connection elements are only connected to the lower sides of the risers on one side. On an erection of a building and a stacking of the modules, connections of the respective last module only have to be connected to risers of the existing module. Corresponding insulating means can likewise be stored in the module. A maintenance opening, for example an EI90 maintenance opening, can also be provided at the duct comprising the risers to enable access to the ductworks of the modules or to the respective duct. The maintenance opening can be configured as described above in connection with the ductwork duct.

Provision is made in an embodiment that the bearing cross laminated timber boards of the outer walls, of the ceiling and/or of the floor are at least lined and/or coated over a part area.

In an embodiment, a lining of the cross laminated timber boards of the outer walls having drywalls is provided. Plaster can be provided in an embodiment. In an embodiment, a fill and/or footfall sound insulation and/or screed and/or a floor covering such as parquet or tiles or laminate is/are provided on the upper side of the cross laminated timber boards of the floor. In an embodiment, the cross laminated timber boards of the ceiling are lined or coated, at least over a part area, at the lower side.

In an embodiment, lining is attached to the cross laminated timber boards using a swing hoop.

Provision is made in an embodiment that the useful area is at least partly formed by a wet room. A wet room is to be understood in the broadest sense as a room in which water connections are present and in which at least the floor is water-resistant. It is a bathroom in an embodiment, for example. Shower cubicles, laundry rooms, separate WC rooms, or storage rooms are furthermore conceivable. In an embodiment, the floor and preferably also at least part areas of the walls for the wet room are coated or lined in a watertight manner. A watertight floor covering of plastic or by tiles can, for example, be provided.

In an embodiment, the inventory of the wet area is pre-installed in the module. Suitable inventory is dependent on the kind of wet area and can, for example, comprise a tub, a shower, a wash bowl and/or a toilet in the case of a bathroom. Mirrors, mirror cabinets, accessories, furniture, and the like can be pre-installed. The connection of the installations of the wet room preferably takes place to a compact station or metering station arranged in the plant room, the former then being or being able to be connected to risers in the vertical duct of the module. The interfaces for the connection of separate consumers such as a washing machine are also connected to the compact station.

In an embodiment, the useful area only comprises one room, that is, it is not divided into a plurality of rooms. In another embodiment, the useful area comprises at least two rooms that are separated from one another by partition walls. At least one of the rooms or both rooms can be wet rooms. For example, the module can have two rooms, namely a bathroom and a separate WC room, washroom, or storage room.

In an embodiment, the useful area of the module is barrier-free and handicap-accessible. The same applies to the entrances into the useful area.

In an embodiment, the module comprises an electrical sub-distributor. It can be a distributor configured as a hybrid distributor that also comprises data technology and TV technology and/or a reserved space for wireless LAN technology in addition to electrotechnical equipment such as residual current operated devices or automatic cut-outs. The electrical sub-distributor can be completely cabled and connected, with the free ends of the supply cables, for example, the electrical feed, data line, and TV cable being able to be disposed, as described in more detail above, in the respective duct of the module.

In an embodiment, the module comprises an underfloor heating distributor cabinet. In an embodiment, the latter is connected to an underfloor heating distributor completely connected at the heating side. It can be completely connected to an underfloor heating of the module that may be present. Provision can furthermore be made that free cable ends and, optionally, cable sections of different connector cables such as connector cables for the connection of consumers such as wall outlets, light outlets, a cooker or the like are received in the underfloor heating distributor cabinet, for example as rolled-up cable bundles. The underfloor heating distributor cabinet can be connected to the electrical sub-distributor. Instead of the underfloor heating distributor, the reserved space in the heating distributor cabinet can also only be provided for cable ends and cable sections if no underfloor heating is provided. The underfloor heating distributor cabinet can be attached to the module at a level beneath the electrical sub-distributor.

Provision is made in an embodiment that installation connections are provided at the outer side of the module. The connection here also preferably takes place to the compact station or metering station arranged in the plant room. Examples include feed lines and return lines for the building heating or lines for the connection of a kitchenette. An outer wall of the module can, for example be suitable due to its connectors to attach a kitchenette to it in a building. A building can thus be erected while using the module in which no further risers or cable lines extend outside the module.

Provision can therefore be made that the total electrical installation of the module is prepared so much that on the construction of a building using the module all the installations and electrical sub-distributors are pre-installed (laid, fastened, and connected) from the lowest floor of the building up to the consumers (power outlets, switches, light outlets, . . . ). of the respective topmost module. Cables for the primary supply (apartment feed) and for the secondary supply (consumer connectors) from the electrical sub-distributor can be stored and laid to the destination in a connection-free manner.

Provision is made in an embodiment that connection lines (feed and return) for the supply of radiators in the useful unit (residential unit) are provided at the outer side of the module and are preferably connected to the compact station or metering station arranged in the plant room.

Provision is made in an embodiment that the module comprises means for a decentralized hot water preparation, both for hygienically sound drinking water heating and for a drinking water heating by heating water in the flow principle.

As regards the manufacture of the module, the cross laminated timber boards of the outer walls and also of other wall elements of the module can be manufactured using an apron method described here.

The wall elements of the module can be connected with the aid of metal connectors and/or by adhesive bonding to the floor and/or to the ceiling of the module.

It can be stated that the vertical ducts are spatially separated, for example by fluids, on the one hand, and by electric media, on the other hand. They also form a separate fire compartment EI90 after stacking of the modules and correspond to all common acoustic protection demands.

The duct installations are designed such that up to five or up to eight or more than eight modules stacked on top of one another can be supplied with all the required media as described above. This can include, for example, heating, cold water, hot water, waste water, ventilation, power, data, TV, and a reserve for further media. One and the same standardized duct installation can also cover all the demands for variants such as low temperature heating, panel heating, convective heating panels (radiators) and central or decentralized hot water preparation. Apparatus for the hydraulic balance of the heat supply such as a differential pressure regulator are preferably integrated in the module. No further measures for the hydraulic balance outside the module are therefore preferably required in a building erected using the module. Noise transfer such as telephony noise transfer between modules above one another can be countered, for example, by the installation of sound absorbers.

Figure 2:
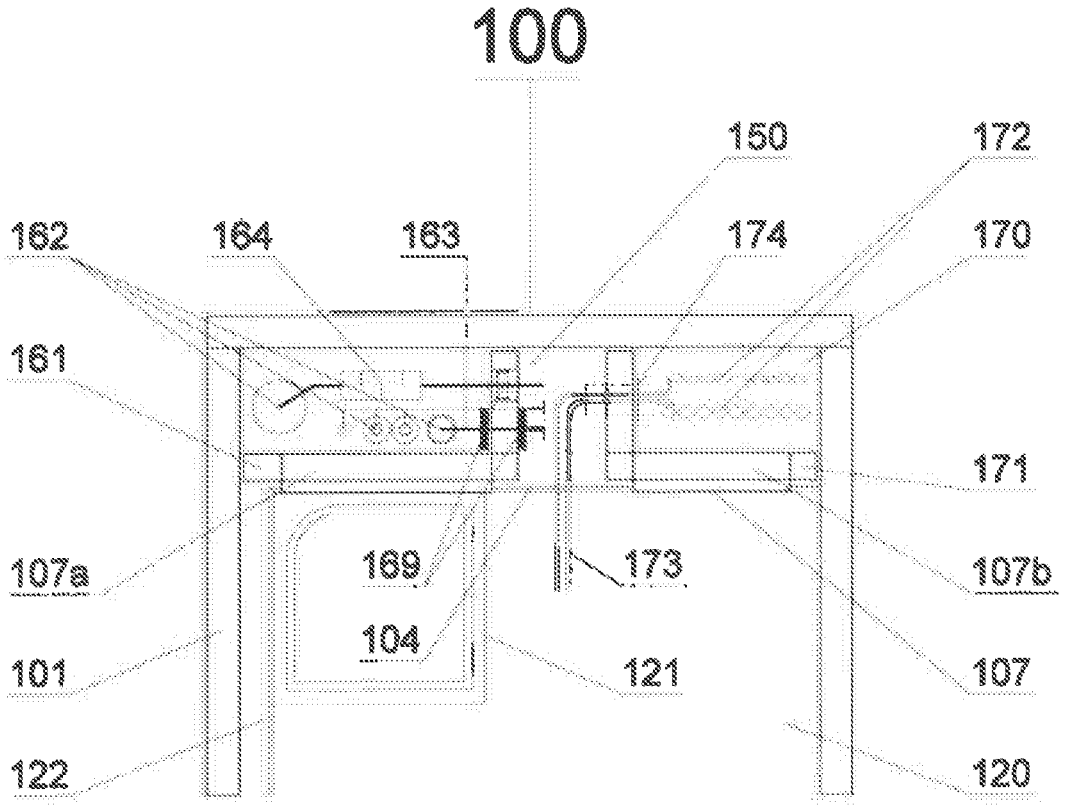
FIG. 2 shows a detailed view of the area around the plant room of the module in accordance with FIG. 1 in a horizontal sectional view.
Figure 3:
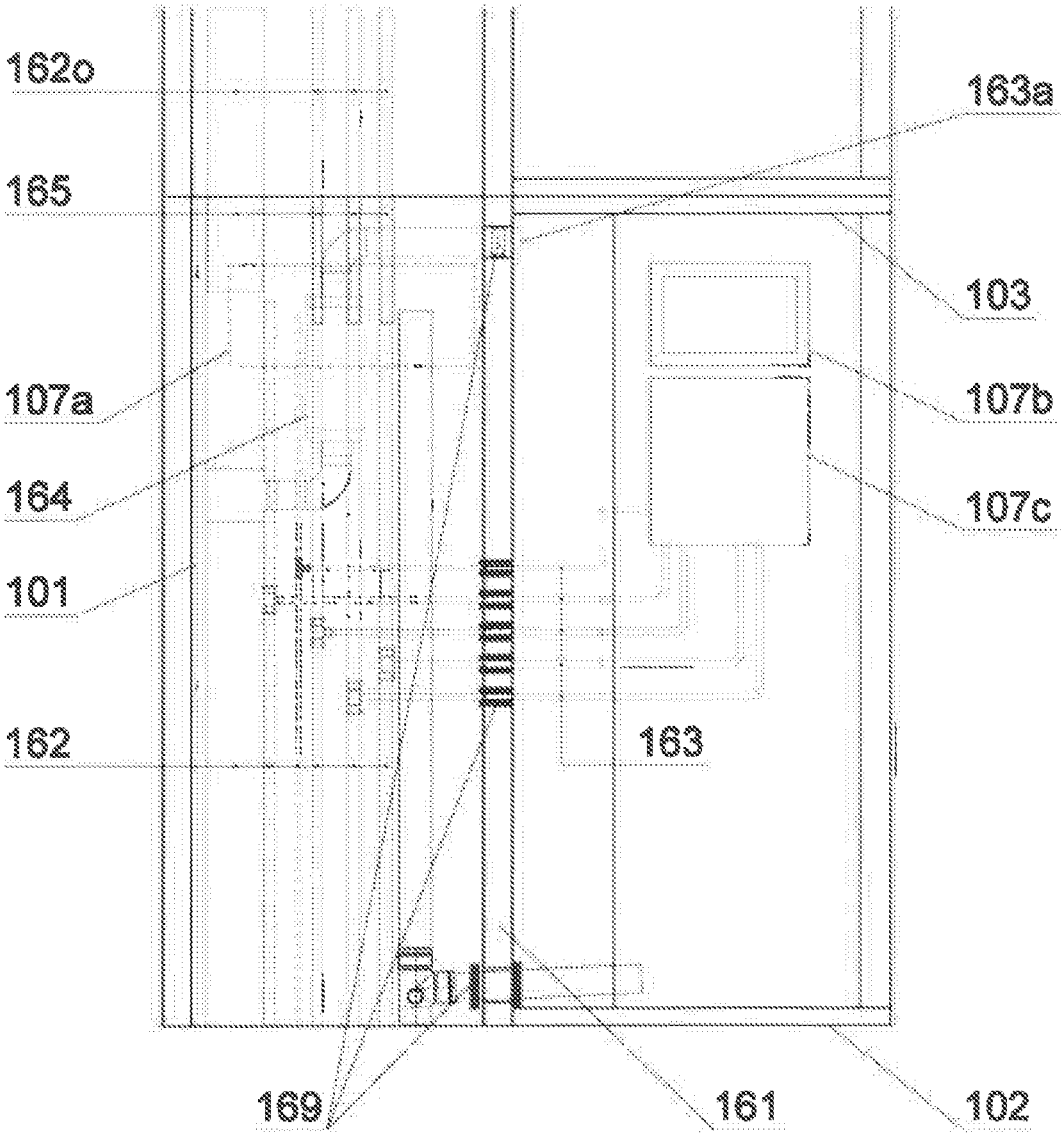
FIG. 3 shows a further detailed view of the area around the plant room of the module in accordance with FIG. 1 in a vertical sectional view.
Figure 4:
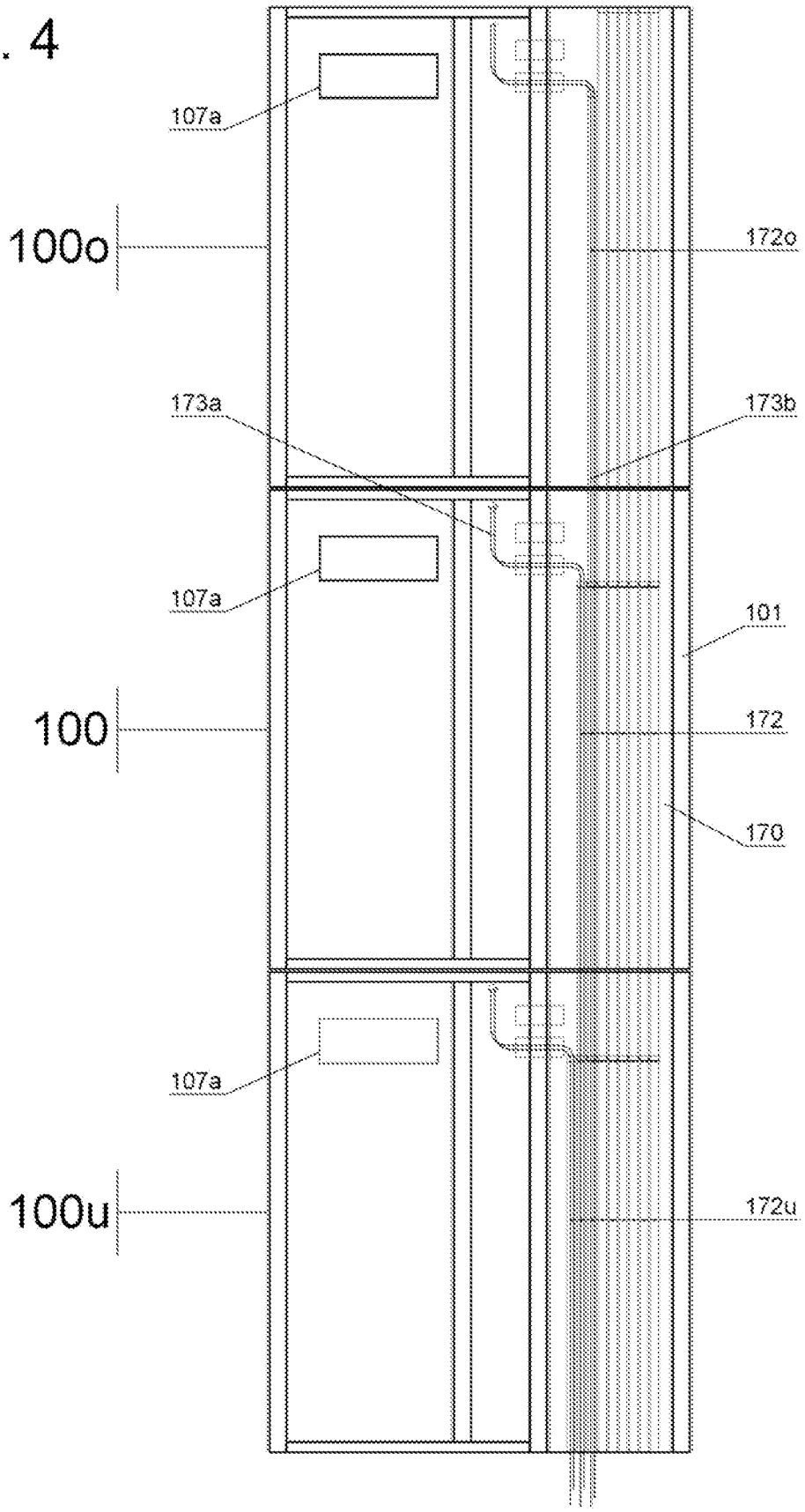
FIG. 4 shows a further detailed view of the area around the plant room of the module in accordance with FIG. 1 in a different vertical sectional view.

FIG. 1 shows an exemplary module in accordance with the invention in a ground plan; FIGS. 2 to 4 show detailed views of the area around the plant room of the module in horizontal and vertical sectional views.

The module is generally marked by the reference numeral 100. It has a rectangular ground plan having four outer walls 101. The outer walls 101 are produced from load-bearing cross laminated timber boards that are at least partially coated and lined in a manner described in more detail below. The module 100 is closed at the bottom and at the top by a floor 102 and by a ceiling 103. The floor 102 and the ceiling 103 are also produced from bearing cross laminated timber boards that are at least partly coated and lined in a manner described in more detail below.

The cross laminated timber boards of the outer walls 101 can be produced using a method such as is described in more detail below or, in particular when no window openings or door openings are present, can comprise one or more large cross laminated timber boards. The floor 102 and the ceiling 103 can, for example, comprise one or more large cross laminated timber boards, but can also be produced using a method described in more detail below.

The inner space bounded by the outer walls 101 is divided into a useful room area 120 and into a plant room 150. The plant room 150 is separated from the useful area 120 by a partition wall 104 composed of drywall or cross laminated timber. Two vertical ducts 160 and 170 that are formed between two L-shaped wall elements 161 and 171 and the corners of the plant room 150 formed by the outer walls 101 extend within the plant room 150. The floor 102 and the ceiling 103 comprise apertures in the region of the vertical ducts 160 and 170 so that the vertical ducts 160 and 170 can run through the module 100 from the bottom to the top. The L-shaped wall elements 161 and 171 are likewise produced from cross laminated timber boards that are coated in a manner described in more detail below.

At least one maintenance opening 107 having a closure element is provided in the partition wall 104 to be able to access a compact station and metering station 107*c* arranged outside the useful area 120 at all times without tools from the useful area 120. Furthermore, two maintenance openings 107*a* and 107*b* having a magnetic closure element and a linear magnetic locking bolt are provided in the partition wall 104 and in the duct wall 161 and 171 to allow access only to trained personnel.

The useful area 120 is a wet room having pre-installed inventory 121 in the form of a shower, a washbowl, and a WC. A bathtub can naturally be pre-installed in addition to or instead of the shower. All these elements are arranged at the partition wall 104 or at an outer wall 101 extending sectionally at the useful area 120 and provided with a liner 122 composed of drywall to be able to lay lines invisibly from the plant room 150 to the connections for the inventory 121.

A door opening 106 in a side wall 101 enables access to the useful area 120. The side wall 101 having the door opening 106 is not lined in the embodiment shown, but could also be lined.

The left vertical duct 160 comprises a plurality of risers 162 for inter alia heating, cold water, hot water, circulation, waste water, and extracted air. Branches 163 that lead through the wall 161 of the vertical duct 160 into the plant room 150 and are led from there to connections at the compact station and metering station 107*c* branch off from these risers 162. A sound absorber 164 is provided at the branch of the extracted air line 163*a*. The risers 1620 of adjacent floors are connected by flexible connection hoses or connection pipes 165. Tested fire-resistant elements 169 are provided in leadthroughs in the wall 161 for the branches 163.

The right vertical duct 170 comprises a plurality of ductworks 172 for cables 173 such as power cables, data cables, TV cables, and other signal cables. The cables 173 for the respective floor are led through the wall 171 of the vertical duct 170 into the plant room 150 and from there to an electrical sub-distributor at the outer wall of the module. Tested fire-resistant elements/measures 174 are provided in leadthroughs in the wall 171 for the cables 173.

As is indicated in FIG. 4, the ductworks 172 are socket pipes that are fixed in the vertical duct 170 such that they can be vertically downwardly displaced from a defined starting position up to and into an end position. On the erection of a multistory building, once the respective module has been placed onto a module below it, the ductworks 172 of the current module 100 are placed onto the ductworks 172*u* of the lower module 100*u* to form a continuous ductwork. The cables of the current module 100 stored in the free space in the duct 170 are then introduced into the ductworks 170*u* of the module 100*u* below and are pushed through fully downwardly until they exit with a predefined excess length at the lowest point of the pipe that arises by pushing together the ductworks of all the modules disposed below the current module 100. As can be seen, a plurality of identical ductworks 172 of the same function are present for a plurality of modules disposed above one another in the vertical duct 170. The cable bundle 173*a* for the current module 100 is completely connected to the electrical sub-distributor of the current module 100. Cable bundles 173*b* of modules above it are led through the ductworks 172 of the current floor.

The duct walls 161 and 171 and the regions disposed at the ducts 160 and 170 have noise-absorbing and fire-resistant properties. The ducts 160 and 170 can thus be vertically acoustically decoupled and a propagation of fire from the ducts 160 and 170 or into the ducts 160 and 170 can be prevented.

The cross laminated timber boards of the outer walls 101 are provided at least over a partial area with a watertight coating at the inner side facing the useful area 120.

At least one screed is applied to the upper side of the cross laminated timber board of the floor 102. It should be achieved by the installed floor structure that the story separating ceiling satisfies the standard REI90 and that all the legally required sound insulation values are reached and fallen short of. The floor structure is therefore designed with footfall sound insulation above the fill in an example and either with a cement or dry screed; the floor covering is selectable. The lower side of the story separating ceiling is composed of cross laminated timber in visible quality in an example or is designed in a dry screed structure with a suspended ceiling.

The module 100 shown receives all the components for heating, sanitation, and electromechanics required for the supply of a residential unit. The most varied heating systems and hot water preparation systems can be operated by a simple replacement of a component. This, for example, includes a compact station having a decentralized hot water preparation for radiators, a compact station having a decentralized hot water preparation for panel heating, a metering station for central hot water preparation for radiators and/or for panel heating, or a hybrid electrical distributor equipped with technologies for electrics and data/media together with a cabinet below with room for cable storage and an underfloor heating distributor.

All the connections required for a residential unit are attached to the module 100. These connections include radiator connections (feed/return), underfloor heating connections (at the installed underfloor heating distributor), and sanitary connections (cold water, hot water, and waste water) for a kitchen or other sanitary consumers. A technical regulation preparation for single room regulation of the underfloor heating variant is integrated.

Furthermore, all the required components for utility bill invoicing conforming to law are integrated in the module 100. They include a cold water meter bridge, a hot water meter bridge, and heat amount meter bridge. Ultimately, components for preparing a remote meter reading are integrated in the module 100.

The module 100 comprises two types of maintenance openings 107 and 107*a*/107*b* to enable access to the components in the plant room 150 or in the vertical ducts 160 and 170. These types comprise an opening 107 that is accessible to all and that is closed by means of a magnetic snap closure. This opening leads to the compact station or metering station 107*c*. Another type 107*a*/107*b* is only accessible to trained operators. It comprises the same closure type that is, however, secured by a linear magnetic locking bolt that can only be moved into the open position by means of a special cable bridge. This opening leads to the duct connections.

The Apron Method

A further aspect of the invention is directed to a method of manufacturing wall elements for buildings, wherein cross laminated timber panels of a specific width and length are stored in a store, and wherein the panels are sawed up transversely to the longitudinal direction to obtain cross laminated timber panels of the same width and of a smaller length, with a plurality of panels being placed transversely to the direction of running on a conveying track, and indeed such that the panels are flush at the top and bottom and the side edges of consecutive panels contact one another, with the panels on the conveying track being connected along the contacting longitudinal sides to form a cross laminated timber apron, and with the apron being sawed up transversely to the direction of running of the conveying track to obtain cross laminated timber boards of a defined width.

The height of the apron and of the cross laminated timber boards corresponds to the length of the panels. The method in accordance with the invention has the advantage that cross laminated timber boards of any desired height and width can be manufactured from simple standard panels in an automated process. It is achieved by the method that the possible width of the boards is not restricted to a multiple of the width of the panels, but can rather be freely selected. A gain in precision further results from this handling. For tolerances in the width of the panels are not passed on to the outer dimensions of the boards. Instead a fixing takes place directly in the process using a precision saw, for example. Dimensional accuracies of +/−1 mm can be achieved with large boards.

Wall elements manufactured using the method can serve as outer walls or inner walls in the finished building, for example. The wall elements manufactured using the method can, for example, be used as side wall elements of a module in accordance with the invention. A use as ceilings and/or floors is also conceivable.

All the panels of the store preferably have the same width. The thicknesses and lengths of the panels are preferably standardized, but do not always have to be the same. Provision can, for example, be made that the panels are between 5 and 20 m in length and between 1 and 2.5 m in width. Preferred dimensions amount to 10-16 m in length and 1.25 m in width. The thickness of the panels can amount to between 6 and 24 cm. Preferred thicknesses amount to 10, 12, or 14 cm. Panels of these dimensions can be transported in simple trucks without any excess length or excess width. They can be manufactured easily and can be handled using standard tools. Cross laminated timber panels of these dimensions are available as standard.

The lengths of the panels and thus the height of the apron and of the boards can amount to between 3 m and 4 m, for example.

The resulting cross laminated timber boards can serve directly as wall elements or also as ceiling elements, floor elements, and roof elements.

Provision can alternatively be made that intermediate parts are furthermore provided and are placed into gaps formed previously between adjacent boards on the conveying track, with the boards arranged in this manner and intermediate parts being able to be connected to form a wall element.

The intermediate parts can, for example, be intermediate boards of cross laminated timber, glue laminated timber, or solid construction timber. The height of such intermediate boards is less than the height of the large cross laminated timber boards. If intermediate boards are used, provision can preferably be made that they are placed into the gaps such that each intermediate board is flush with the adjacent boards at the top or bottom and/or that the side edges of the intermediate boards and of the adjacent boards contact one another. The boards can then be connected along the contacting side edges. The use of intermediate supports of, for example, likewise timber or of steel is furthermore conceivable.

A relief in the wall element furthermore arises below or above the intermediate parts. The relief represents a window opening or a door opening. The intermediate parts serve as shoulders when they extend in the lower region of the boards, for example flush with the lower edge of the boards, or as ledges when they extend in the upper region of the boards, for example flush with the upper edge of the boards. The height or the vertical extent of the intermediate parts can amount to 135 cm, for example, for the use as a shoulder. The height or the vertical extent of the intermediate parts can amount to 22 cm, for example, for the use as a ledge.

This production method has the great advantage over conventional methods of the production of wall elements having window openings where the window opening is cut out or machined out of a board that almost no offcuts are incurred. This lack of offcuts results in significant cost savings in the large technical production of wall elements and increases the sustainability of the concept overall.

Provision is made in an embodiment that two intermediate parts are inserted into the gap, with one intermediate part being arranged at the upper side of the board, for example flush with the upper edge, and one intermediate part being arranged at the lower side of the board, for example flush with the lower edge of the board. Window openings having a shoulder and a ledge can thus be worked into the wall elements. The window opening is formed by the still open region of the gap between the upper side of the lower intermediate part and the lower side of the upper intermediate part.

Provision is made in an embodiment that at least some of the intermediate parts are intermediate boards that are manufactured in that cross laminated timber panels of the store are sawed up transversely to the longitudinal direction to obtain cross laminated timber panels of the same width and having a smaller length in comparison with the panels; that a plurality of short panels are placed onto a second conveying track transversely to the direction of running, and indeed such that the short panels are flush at the top and at the bottom and the side edges of consecutive short panels contact one another; that the short panels on the second conveying track are connected along the contacting longitudinal sides to form a second cross laminated timber apron; and that the second apron is sawed up transversely to the running direction of the second conveying track to obtain intermediate boards of a defined width.

Provision can therefore be made, in other words, that the apron process used for the manufacture of the large boards is also used for the manufacture of intermediate parts in the form of intermediate boards. This has the advantage of smaller width tolerances and of any desired choice of width.

Provision is made in an embodiment that at least some of the intermediate parts are intermediate boards that are obtained by sawing up cross laminated timber panels of the store transversely to the longitudinal direction. Intermediate boards having a width of, for example, 1.25 m corresponding to the width of the timber panels can thus be simply manufactured.

Since the panels are cross laminated timber panels, the boards and optionally at least some of the intermediate boards consist of cross laminated timber. Cross laminated timber is available in said dimensions and is particularly advantageous for use in the present method with which wall elements for houses and, for example, for just such modules should be manufactured for the reasons already named in connection with the module.

Provision is made in an embodiment that at least some of the intermediate boards or intermediate supports are provided separately, with these some intermediate boards preferably being intermediate boards or intermediate supports of glue laminated timber or solid construction timber or steel.

Provision is made in an embodiment that the connection of the adjacent panels and/or of the short panels and/or boards and/or intermediate parts takes place by the use of mechanical connection means or by gluing. The elements can, for example, be connected by hammering in clamps. A connection must likewise be mentioned using screws, with the aid of a wooden riser or with the aid of an external spring. Alternatively or additionally, the elements can be glue laminated. This is preferred since the potential problem of metal parts at positions at which the apron is to be cut does not occur.

Provision is made in an embodiment that a piece of the apron is cut off and is disposed of if a cut is to be carried out at a non-permitted point during its sawing up such as in the region of a connection clamp between two panels.

Provision is made in an embodiment that cut-off end pieces of the apron are placed in intermediate storage and are placed into the or an apron again at later time as a cross laminated timber panel. A change of the apron height may, for example, become necessary in the process due to a change of the desired room height. It can thus become necessary to cut off an end piece of the apron. This is then put into intermediate storage and is again used as a counterpart to a long panel in the apron at the next opportunity on a return to the original apron height.

Figure 5:
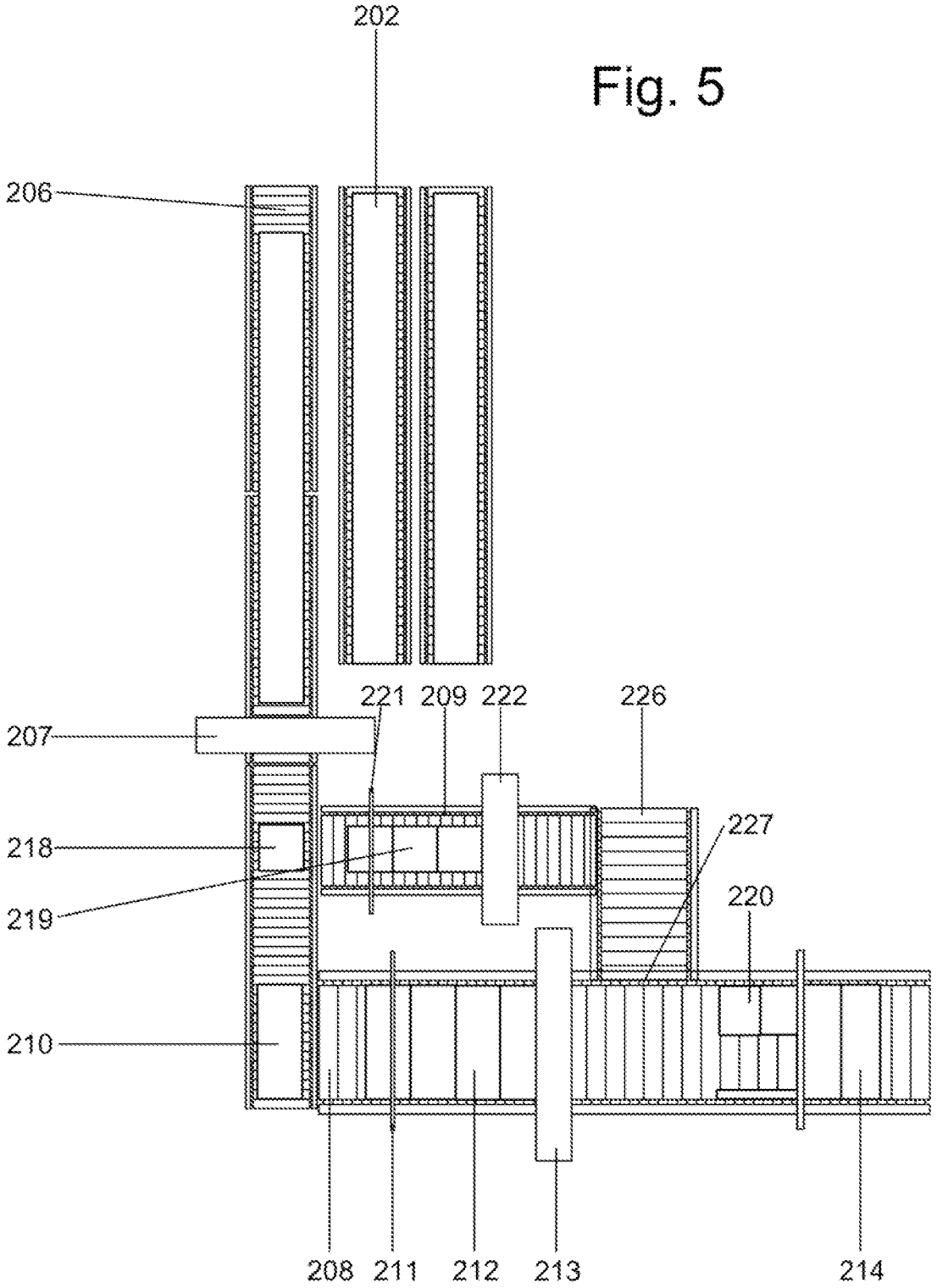
FIG. 5 shows an exemplary factory layout for carrying out an apron production method in accordance with the invention for manufacturing wall elements.

An exemplary factory layout for carrying out an apron production method in accordance with the invention for manufacturing wall elements is shown in FIG. 5.

The factory comprises an arrival region for trucks with a store 202 arranged directly adjacent thereto. The store 202 comprises individual storage regions for pallets having standardized cross laminated timber panels of specific dimensions. Some or all of the store regions preferably have the same dimensions to be able to receive cross laminated timber panels of the same dimensions. Only cross laminated timber panels of the same width are required as the starting material for the most predominant part for the method in accordance with the invention so that an ideal utilization of space is achieved with a store designed in this manner. Sufficient material can be kept in stock with a limited space requirement. If cross laminated timber panels of different thicknesses are required, they fit in all the store regions independently of their thicknesses. Suitable dimensions for the cross laminated timber panels include, for example, 1.25×10-16 m. Suitable different panel thicknesses amount, for example, to 10, 12, or 14 cm. They type of the panels received in the individual storage regions of the store 202, i.e. their thickness and their type of wood, is individually advised to an electronic control unit or is preset.

A crane robot is provided above the store 202 to be able to lift the panels just required lengthwise onto a supply path 206. A precision saw 207 is arranged at the supply path 206 and the panels can be shortened by it with a maximum error of +/−1 mm to any desired lengths.

At the other side of the saw, a main conveying track 208 and a secondary conveying track 209 branch off from the supply path 206 transversely at different branches. Both of these tracks 208 and 209 run in the same direction starting from the supply path 206. A control can be made using a manipulation device, not shown in any more detail, as to which of the pieces obtained by sawing up the panels move onto which of the tracks 208 and 209. In an alternative embodiment of the system, a separate supply path beside the existing track 205, including a precision saw, can also be arranged for the secondary conveying track 209.

In the simplest manifestation of the method, only panels 210 of a single length are cut out of the panels in the saw 27 and are directed widthwise flush onto the main conveying track 208. The panels 210 are pushed together there such that their longitudinal edges contact one another. The contacting side edges of the panels 210 are then connected in a connection machine 211 by mechanical connection element 240 and/or by adhesive bonding, preferably by glue bonding, to form a timber apron 212. A further precision saw 213 then saws up the apron 212 normally to the direction of running of the track 208 to obtain timber boards that have the same height as the panels 210 or as the apron 212. The width of the timber boards can be freely selected in the saw 213. The saw 213 is configured such that the apron 212 can be cut up with a maximum error of +/−1 mm into wall boards of any desired width.

Storage positions, not shown in any more detail, for offcuts that can arise, for example, when the wall height, that is, the apron height, is changed are arranged next to the saw 221. These offcuts can be fed in again on a repeat change. In this simplest manifestation of the method, rectangular wall elements of cross laminated timber arise without window openings or door openings that correspond to the wall boards.

In a more complex manifestation of the method, shorter pieces 218 are also cut out of the panels in the saw 207 and are directed to the secondary conveying track 209 or, alternatively from the separate supply path described as an alternative above, onto the secondary conveying track. The shorter pieces 218 are there combined to an apron 219 in accordance with the same principle and are cut into intermediate boards of any desired length such as is done for the panels 210 on the main conveying track 208. A connection machine 221, a precision saw 222, and an offset placement area, not shown in any more detail, are likewise provided on the secondary conveying track 209 for this purpose.

The secondary conveying track 209 ends at a transfer track 226 that leads to the main conveying track 208 and opens into it at combination point 227. Wall boards already cut to finished shape are present at the combination point 227. A store for glue laminated timber supports, or alternatively for solid construction timbers or steel supports, and a manipulation device are furthermore arranged at the combination point 227. The manipulation device also comprises a connection machine in addition to a gripping apparatus for positioning the wall boards, the intermediate boards and the glue laminated timber supports or solid construction timbers or steel supports. Intermediate boards and/or glue laminated timber supports of the same width or solid construction timbers or steel supports are placed into a gap between two wall boards at the manipulation device such that the adjacent side edges contact. The different boards are then mechanically connected or adhesively bonded to one another. A connection machine 215 serves this purpose.

Rectangular wall elements 214 composed of cross laminated timber thus arise having window openings or door openings that are composed of at least two wall boards and at least one intermediate board and/or one glue laminated timber support. The intermediate board here typically serves as a shoulder and the glue laminated timber support serves as a ledge.

Figure 6:
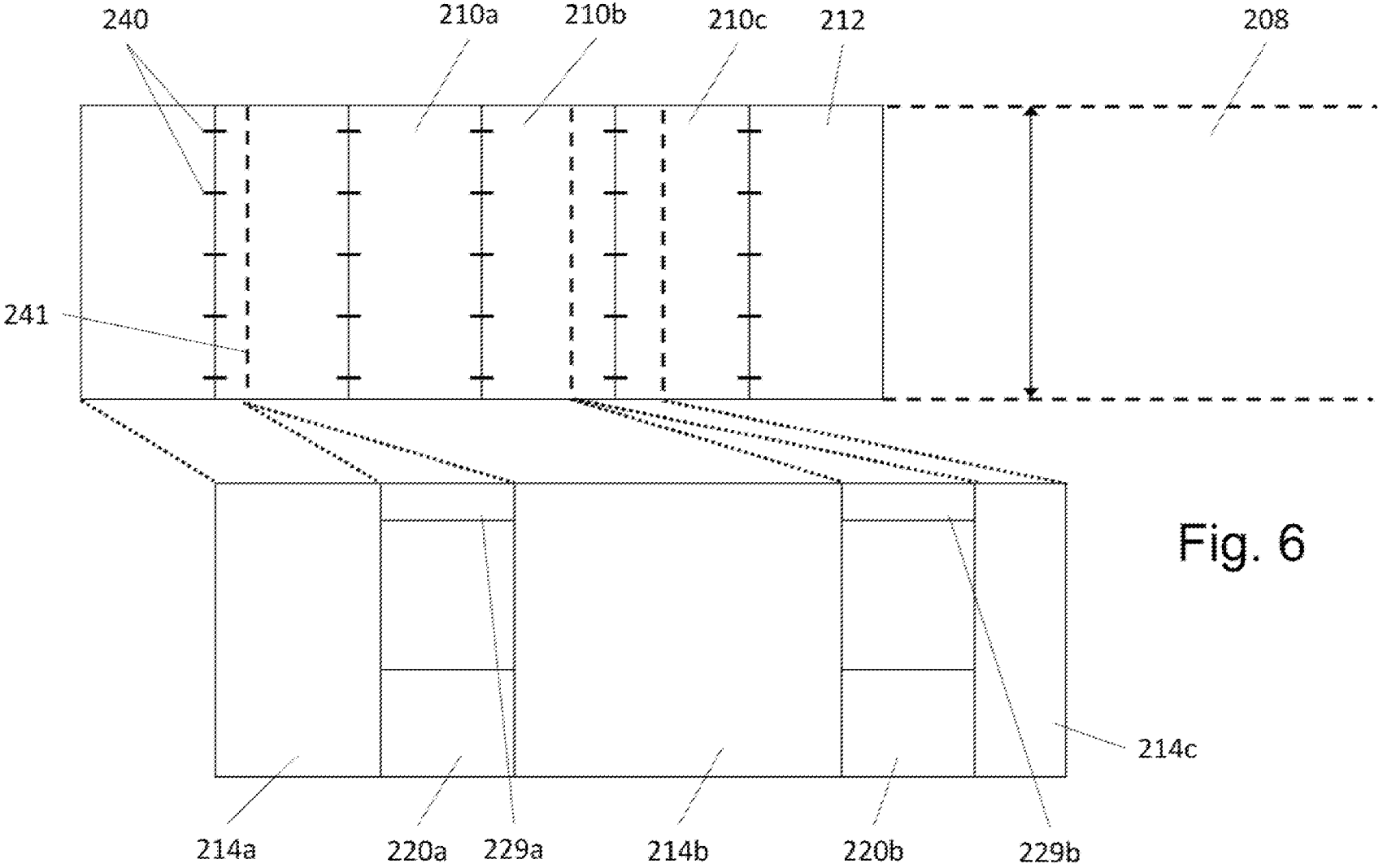
FIG. 6 shows the schematic assembly of an exemplary wall in the apron process.

The finished wall elements, whether with or without window openings or door openings, then move into a processing region that is arranged at the end of the track. FIG. 6 shows the schematic assembly of an exemplary wall in the apron process.

The timber apron 212 located on the main conveying track 208 is shown in the upper part of FIG. 6. It comprises individual cross laminated timber panels 210*a*, 210*b*, etc. that all nominally have the same width of 1.25 m and are adhesively bonded, for example glue laminated and/or mechanically connected, for example using metal clamps, along the common side edges.

It is indicated in the drawings that the widths of the timber panels 210*a*, 210*b*, etc. have a certain tolerance. For example, one timber board is only 1249 mm in width, whereas another timber board is 1260 mm in width. Tolerances in this order of magnitude are by all means possible in cross laminated timber panels provided in a large technical manner and a gain in dimensional accuracy would be associated with substantial additional costs. On the other hand, such tolerances, and optionally such summed tolerances, cannot be tolerated in the finished wall elements for use in a building as part of the concept in accordance with the invention. A substantial advantage of the method in accordance with the invention is therefore that on a processing as part of the method in accordance with the invention of these tolerances can be compensated in the starting material since the apron 212 is anyway divided up by the precision saw 213 such that the width of the boards is correct to the millimeter.

The cutting lines of the precision saw 213 are marked by the reference numeral 241 in the Figure. In the present example, the cutting lines 241 are such that inter alia three boards 214*a*, 214*b*, and 214*c* having widths of 1470 mm, 2910 mm, and 750 mm can be cut out of the apron 212.

In the lower part of FIG. 6, a finished wall element 230 having two window openings is shown that is composed of the three boards 214*a*, 214*b*, 214*c* whose relationship has been explained in the upper part of FIG. 6, and of two shoulders 220*a* and 220*b* of cross laminated timber and two ledges 229*a* and 229*b* of glue laminated timber that each have a width of 1250 mm. The shoulders can be manufactured in the apron process as described in more detail above in connection with FIG. 5. The ledges are manufactured as described in more detail above in connection with FIG. 5 and the use of shoulders and ledges between the boards and their connection to the boards likewise take place as described in more detail above in connection with FIG. 5.

What is claimed is:

1. A method of manufacturing wall elements for buildings, the method comprising:

providing cross laminated timber planks of a specific width and length, the planks being stocked in a store;

cutting the planks crosswise to obtain cross laminated timber panels of, when compared to the planks, the same width in cross direction and a smaller length in principal direction;

placing a plurality of panels onto a conveying track with the principal edges of the panels oriented in a direction transversely to the conveying direction of the conveying track, wherein the panels are placed on the conveying track such that the cross edges at the top and the bottom of the panels are flush with each other and that principal edges of consecutive panels contact each other;

connecting consecutive panels along the contacting principal edges to form a cross laminated timber apron on the conveying track;

cutting the apron in a direction transversely to the conveying direction of the conveying track to obtain cross laminated timber boards of a defined width;

forming gaps between adjacent boards on the conveying track;

providing intermediate parts;

inserting the intermediate parts into the gaps previously formed between adjacent boards on the conveying track; and connecting boards and intermediate parts to form wall elements.

2. The method in accordance with claim 1, wherein two intermediate parts are inserted into some or all of the gaps, with one intermediate part in each of the respective gaps being inserted into the gap such as to be flush with the upper cross edges of adjacent boards and the other intermediate part in each of the respective gaps being inserted into the gap such as to be flush with the lower cross edges of adjacent boards.

3. The method in accordance with claim 1, wherein some or all of the intermediate parts are formed from cross laminated timber;

wherein the method further comprises:

cutting planks piled in the store crosswise to obtain cross laminated timber short panels of, when compared to the planks, the same width in cross direction and a smaller length in principal direction, with the length of the short panels being smaller than the length of the panels;

placing a plurality of short panels onto a second conveying track with the principal edges of the panels oriented in a direction transversely to the conveying direction of that the second conveying track, wherein the short panels are placed on the conveying track such that the cross edges at the top and at the bottom of the short panels are flush with each other and that principal edges of consecutive short panels contact each other; and connecting consecutive short panels along the contacting principal edges to form a cross laminated timber short apron on the second conveying track; and the short apron in a direction transversely to the conveying direction of the second conveying track to obtain the intermediate parts formed from cross laminated timber, these intermediate parts having a defined width.

4. The method in accordance with claim 1, wherein some or all of the intermediate parts are obtained by crosswise cutting of cross laminated timber planks piled in the store.

5. The method in accordance with claim 1, wherein adjacent panels, or adjacent boards and intermediate parts, or both are connected by mechanical connectors.

6. The method in accordance with claim 1, wherein cut-off end pieces of the apron are placed into an intermediate store and are rejoined to a different position of the apron at a later stage.

7. The method in accordance with claim 1, wherein adjacent panels, or adjacent boards and intermediate parts, or both are connected by gluing.

8. The method in accordance with claim 3, wherein adjacent short panels are connected by mechanical connectors.

9. The method in accordance with claim 3, wherein adjacent short panels are connected by gluing.

10. The method in accordance with claim 1, wherein one intermediate part is inserted into some or all of the gaps, the intermediate part in each of the respective gaps being inserted into the gap such as to be flush with the upper or lower cross edges of adjacent boards.

* * * * *